US006517190B2

(12) United States Patent
Matsumoto et al.

(10) Patent No.: US 6,517,190 B2
(45) **Date of Patent: *Feb. 11, 2003**

(54) INK JET PRINTING METHOD AND INK JET PRINTER

(75) Inventors: Nobuo Matsumoto, Kanagawa (JP); Eiichi Kito, Kanagawa (JP); Kiyotaka Kaneko, Kanagawa (JP); Yasuyuki Hosono, Kanagawa (JP)

(73) Assignee: Fuji Photo FIlm Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,364

(22) Filed: Jun. 22, 2001

(65) Prior Publication Data

US 2001/0055044 A1 Dec. 27, 2001

(30) Foreign Application Priority Data

Jun. 26, 2000 (JP) ..... 2000-191717
May 18, 2001 (JP) ..... 2001-149370

(51) Int. Cl.[7] ..... B41J 2/165

(52) U.S. Cl. ..... 347/35; 347/23; 347/104; 347/107

(58) Field of Search ..... 347/23, 35, 104, 347/107

(56) References Cited

U.S. PATENT DOCUMENTS 3,827,355 A * 8/1974 Hamisch, Sr. ..... 101/26
4,001,839 A * 1/1977 Kraus ..... 347/35
5,659,342 A * 8/1997 Lund et al. ..... 347/35
6,402,287 B2 * 6/2002 Matsumoto et al. ..... 347/19

* cited by examiner

*Primary Examiner*—Judy Nguyen
*Assistant Examiner*—Blaise Mouttet
(74) *Attorney, Agent, or Firm*—McGuireWoods LLP

(57) ABSTRACT

An ink jet printer has an ink jet printing head including plural nozzles arranged in a main scan direction, for ejecting ink. A feeder rollers move continuous recording sheet relative to the printing head in a sub scan direction, to print plural images to the continuous recording sheet. A system controller operates to clean the printing head in a beginning or ending position of respectively the plural images. The printing head prints a cutting indicia to the recording material upon being cleaned. The cutting indicia is adapted to separating the images.

33 Claims, 8 Drawing Sheets

INK JET PRINTING METHOD AND INK JET PRINTER

BACKGROUND OF THE INVENTION

1. Field of the Invention

The present invention relates to an ink jet printing method and ink jet printer. More particularly, the present invention relates to an ink jet printing method and ink jet printer capable of removing choking of ink or other failure in a printing head.

2. Description Related to the Prior Art

An ink jet printer is known, and includes an ink jet printing head, which includes a group of nozzles for ejecting ink to recording material to print an image thereto. If the ink jet printer is repeatedly used, choking of ink is likely to occur in the nozzles. It is likely that an ejected amount of ink decreases. Furthermore, no ink may be ejected. This causes unevenness in color or density to occur in a printed image.

In general, an operator observes the printed image, and if there are streaks with unevenness in color or density, changes over the ink jet printer to a head cleaning mode. The printer is cleaned to eliminate the choking of ink or abnormality in a direction of ejecting the ink. In a cleaning process, ink are caused to flow out of the nozzles at a high flow rate. Also, the nozzles are sucked externally to remove choking ink. Furthermore, the periphery of the nozzles is wiped. It is, however, likely that an operator discovers the choking of ink too late. Images may be printed at a low quality due to the failure. If the printer is used by a user at home, no serious problem occurs even with drop in the image quality. However, if the printer is used commercially at a printing shop, failure in operation of the nozzles may cause serious problem due to occurrence of a great number of failing prints to be produced.

SUMMARY OF THE INVENTION

In view of the foregoing problems, an object of the present invention is to provide an ink jet printing method and ink jet printer capable of removing failure in a printing head.

In order to achieve the above and other objects and advantages of this invention, in an ink jet printing method, a printing head is used, and has plural nozzles for ejecting ink. At least one image is printed to recording material with the printing head. Before or after printing the image, the printing head is cleaned by driving at least part of the plural nozzles.

An ink jet printer of the invention has a printing head including plural nozzles arranged in a main scan direction, for ejecting ink. A moving mechanism moves one of the printing head and recording material relative to a remainder thereof in a sub scan direction, to print at least one image to the recording material. A controller operates before or after printing the image, to clean the printing head by driving at least part of the plural nozzles.

The at least one image is plural images. The controller cleans the printing head in a beginning or ending position of respectively the plural images, the printing head prints a cutting indicia to the recording material upon being cleaned, and the cutting indicia is adapted to separating the images.

The recording material is continuous recording sheet or a recording sheet strip.

Furthermore, an indicia sensor detects the cutting indicia. A cutter cuts the recording material at the cutting indicia in response to detection of the cutting indicia, to obtain prints having respectively the images.

The printing head prints a sorting indicia to the recording material upon being cleaned in a beginning or ending position of one series of the plural images, the sorting indicia being different from the cutting indicia in at least one of a width, length, position, color and shape. The indicia sensor further detects the sorting indicia. Furthermore, a sorter is actuated in response to detection of the sorting indicia, for grouping the prints by the series of the images.

In a preferred embodiment, the sorting indicia is different in a position from the cutting indicia with reference to a direction crosswise to arrangement of the plural images.

In another preferred embodiment, the sorting indicia is different from the cutting indicia in a size with reference to the sub scan direction.

In a further preferred embodiment, at least one of the cutting indicia and the sorting indicia includes plural colored portions arranged in a patterned manner.

The cutting indicia includes the plural colored portions arranged at a first pitch, the sorting indicia includes the plural colored portions arranged at a second pitch different from the first pitch.

In a preferred embodiment, a remaining one of the cutting indicia and the sorting indicia includes a single colored portion.

In another preferred embodiment, the plural colored portions are dots.

In an additional preferred embodiment, the plural colored portions are stripes.

In a preferred embodiment, the ink is ink of first to Nth colors, the images are full-color images. The plural nozzles are arranged in first to Nth groups for ejecting the ink of respectively the first to Nth colors. The controller drives one of the first to Nth groups at each time of printing one of the plural images, to print first to Nth cutting indicia cyclically in respectively the first to Nth colors.

In another preferred embodiment, the sorting indicia is different in a position from the cutting indicia.

The plural nozzles are grouped in first to Pth groups with reference to the main scan direction. The controller drives one of the first to Pth groups at each time of printing one of the plural images, to print first to Pth cutting indicia cyclically, the first to Pth cutting indicia being offset from one another with reference to the main scan direction.

In still another preferred embodiment, the moving mechanism is a head carriage for moving the printing head in the sub scan direction, for image printing in a belt shape. Furthermore, a second moving mechanism moves one of the head carriage and the recording material relative to a remainder thereof in the main scan direction, to print the image.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
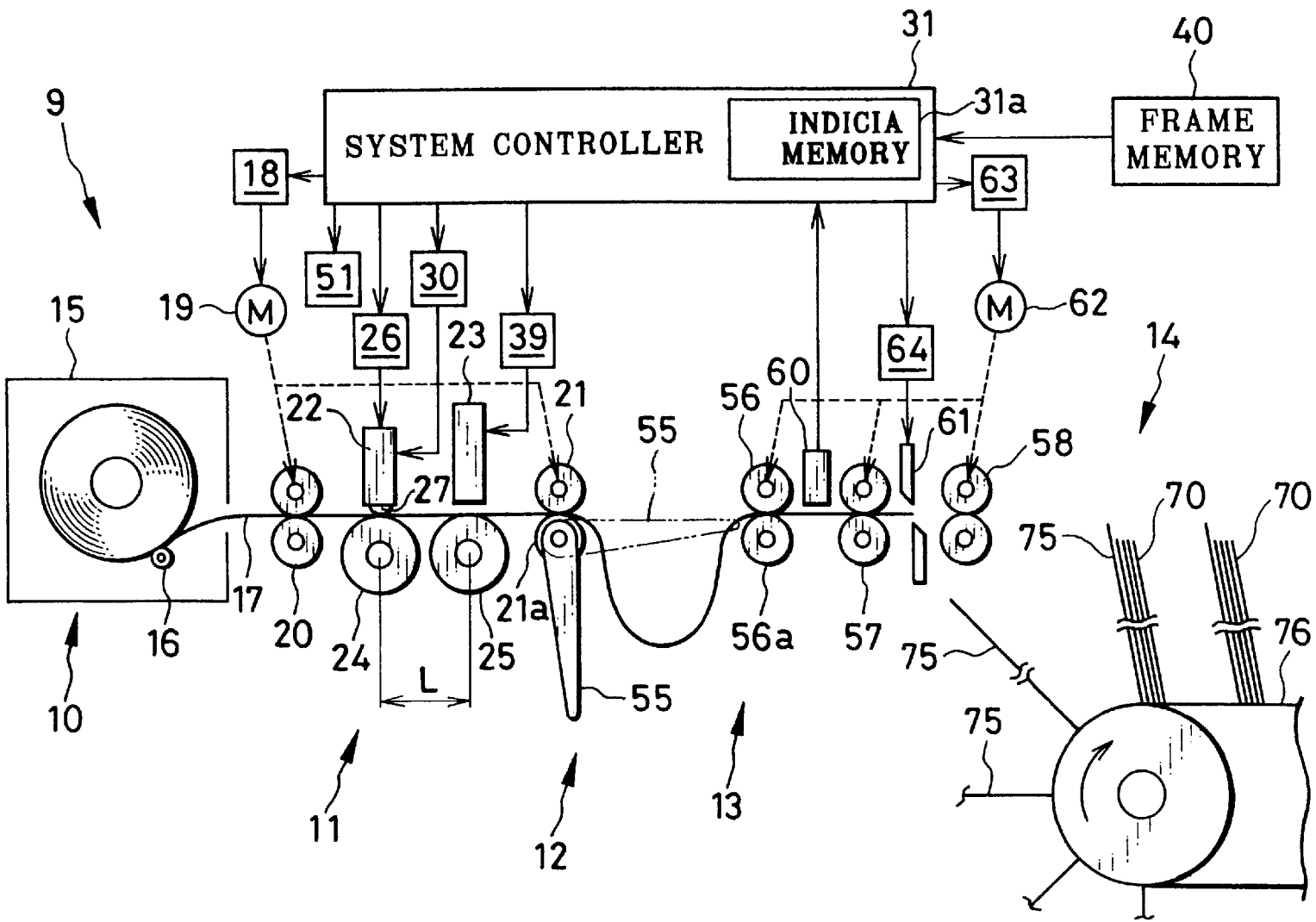
FIG. 1 is an explanatory view in elevation, illustrating an ink jet printer.

In FIG. 1, an ink jet printer 9 is illustrated, and is constituted by a sheet supply unit 10, an image forming component 11, a sheet reservoir 12, a cutter 13 and a sorter 14. A recording sheet magazine 15 is provided with a supply roller 16, which is rotated by the sheet supply unit 10 to unwind and advance continuous recording sheet 17 as recording material from the recording sheet magazine 15. The continuous recording sheet 17 is supplied to the image forming component 11. In the present embodiment, the continuous recording sheet 17 has a width of a region in the A4 format, in other words approximately 210 mm. Each print to be obtained from the continuous recording sheet 17 has the A4 format. Of course, the width of the continuous recording sheet 17 and the size of each image frame may be changed in a suitable manner.

The image forming component 11 is constituted by a feeder roller sets 20 and 21, a preheating thermal head 22, and an ink jet printing head 23. The feeder roller sets 20 and 21 in combination operate as moving mechanism. A motor 19 is driven by a motor driver 18, and causes the feeder roller sets 20 and 21 to rotate in nipping the continuous recording sheet 17. The thermal head 22 and the printing head 23 are disposed between the feeder roller sets 20 and 21, and extend in a main scan direction M that is crosswise to feeding of the continuous recording sheet 17. There are platen rollers 24 and 25 disposed under the thermal head 22 and the printing head 23 for supporting the continuous recording sheet 17.

Figure 2:
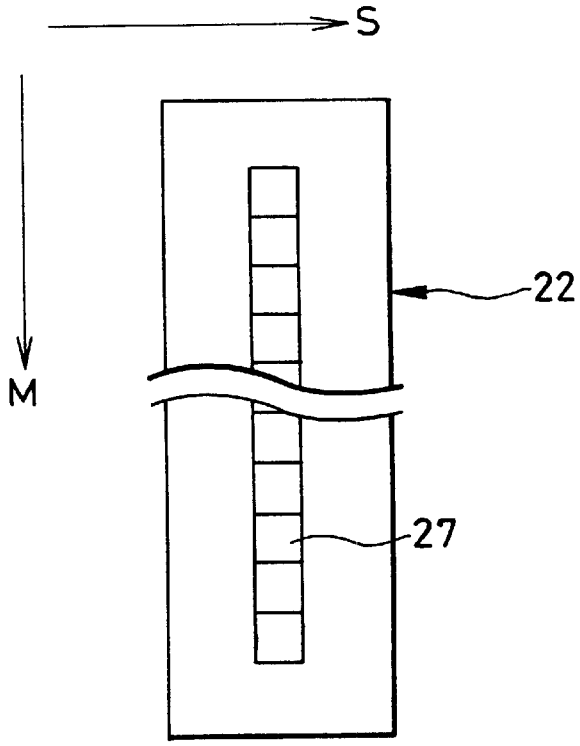
FIG. 2 is a plan illustrating a thermal head for preheating.

A shifter mechanism 26 shifts the thermal head 22 up and down. During printing of the printing head 23, the shifter mechanism 26 keeps the thermal head 22 shifted down, so the continuous recording sheet 17 is squeezed between the thermal head 22 and the platen roller 24 to preheat the continuous recording sheet 17 with the heating elements. At the time of not printing, the shifter mechanism 26 keeps the thermal head 22 shifted up away from the continuous recording sheet 17. In FIG. 2, a great number of heating elements 27 are disposed in the thermal head 22 and arranged in the main scan direction M. Preheating by use of the thermal head 22 is for the purpose of drying ejected ink on the continuous recording sheet 17 at a short time upon printing with the ink.

In FIG. 1, a preheating head driver 30 drives and controls the heating elements 27 in the thermal head 22. A system controller 31 sends the preheating head driver 30 drive data determined for each of the heating elements 27. The drive data is determined according to an ejected amount of ink from the printing head 23. For pixels of which the ejected amount of ink is high, relatively high preheating heat energy is applied to the pixels by the heating elements 27 in the thermal head 22. For pixels of which the ejected amount of ink is low, relatively low preheating heat energy is applied to the pixels by the heating elements 27 in the thermal head 22.

In view of efficient cooling after preheating, the distance L between the thermal head 22 and the printing head 23 should be as small as possible. According to the distance L, a position in the continuous recording sheet 17 for starting preheating of the thermal head 22 is determined. Also, a position in the continuous recording sheet 17 for starting printing of the printing head 23 is determined. Feeding and printing are controlled so that printing with the printing head 23 is started in the printing starting position.

Figure 3:
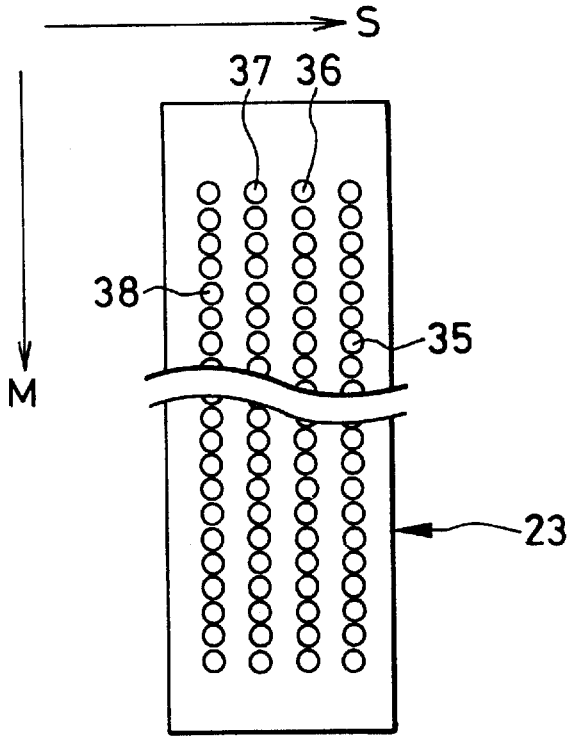
FIG. 3 is a plan illustrating an ink jet printing head.

In FIG. 3, the printing head 23 includes arrays of nozzles 35, 36, 37 and 38 as recording elements for line printing of four colors including yellow, magenta, cyan and black colors. As is well-known in the art, the printing head 23 accommodates piezoelectric elements disposed in an ink flowing path close to the nozzles 35, 36, 37 and 38. The ink flowing path is shortened or extended by the piezoelectric elements, to eject and supply ink.

As illustrated in FIG. 1, a printing head driver 39 drives and controls each of piezoelectric elements. The printing head driver 39 sends the piezoelectric elements a drive signal determined according to image data. The system controller 31 is connected with the printing head driver 39. A frame memory 40 is connected with the system controller 31, which writes image data to the frame memory 40, the image data being input by an image reader device or image output device.

The system controller 31 determines drive data for the piezoelectric elements in the nozzles 35–38 according to image data of the respective colors. The drive data is sent to the printing head driver 39. Then the system controller 31 causes the printing head driver 39 to drive the piezoelectric elements in synchronism with feeding of the continuous recording sheet 17. Ink droplets in a size and a number determined according to the image data is ejected toward the continuous recording sheet 17, and deposited to the continuous recording sheet 17. Therefore, a full-color image is printed to the continuous recording sheet 17 with ink of yellow, magenta, cyan and black colors.

In the present embodiment, both the dot diameter control and dot density control are used for expressing gradation so as to produce a print with high quality. However, only one of the dot diameter control and dot density control may be used. The arrays of the nozzles or printed lines are arranged at the regular pitch in the sub scan direction S. Image data for driving the piezoelectric elements are output according to differences of the lines of the colors in the sub scan direction S. Ink droplets for the four colors are deposited to the same position irrespective of the arrangement of the nozzles 35–38.

Figure 4:
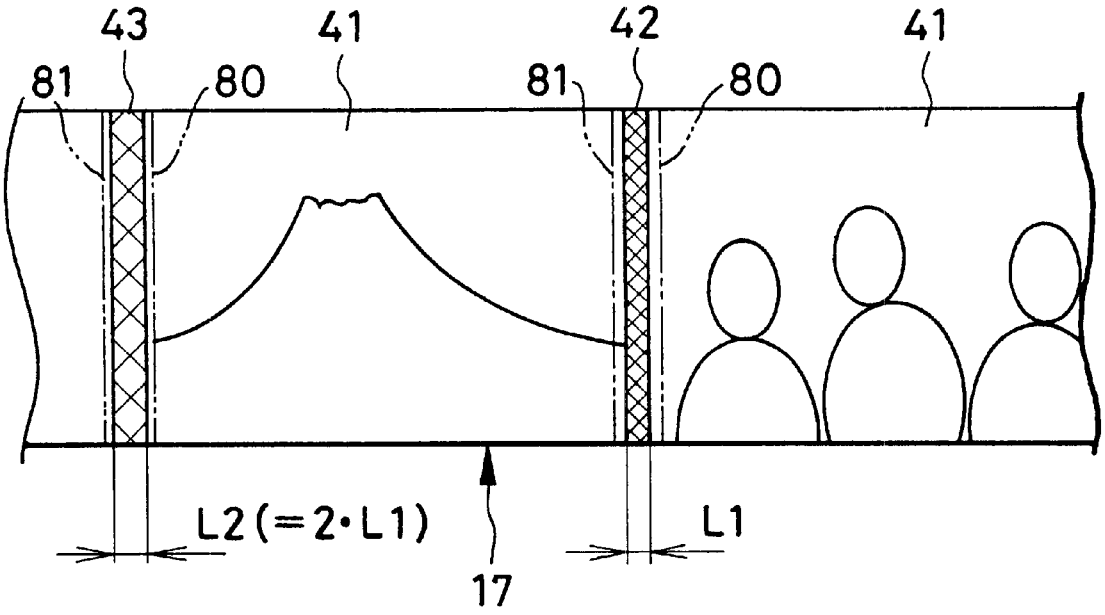
FIG. 4 is a plan illustrating continuous recording sheet provided with cutting and sorting indicia.

An indicia memory 31*a* stores data for creating indicia. The system controller 31 controls printing of a cutting indicia 42 and a sorting indicia 43 along borderlines of images 41 as illustrated in FIG. 4 according to the indicia creating data. In the present embodiment, the sorting indicia 43 is determined distinct from the cutting indicia 42 by changing the sizes L1 and L2 in the sub scan direction S in which the continuous recording sheet 17 is fed. The sizes L1 and L2 are correlated as L2=2×L1.

The cutting and sorting indicia 42 and 43 are printed by ejecting of ink through the nozzles at a higher flow rate than that for image printing. The cutting and sorting indicia 42 and 43 are created in the black color, because ink of the black, yellow, magenta and cyan is provided in each indicia printing region.

In FIG. 1, there is a pulse generator 51 connected with the system controller 31 for detecting an amount of feeding the continuous recording sheet 17. The pulse generator 51 contacts the continuous recording sheet 17, and generates pulses in the number proportional to the feeding amount of the continuous recording sheet 17. The system controller 31 counts the number of the pulses from the pulse generator 51, and obtains the feeding amount per unit time. According to the feeding amount, the system controller 31 determines timing of driving the thermal head 22 and the printing head 23. Also, the system controller 31 compensates for drive data of the heating elements 27 according to the feeding speed of the continuous recording sheet 17. For example, the heat energy from the heating elements 27 is set higher according to an increase in the speed of the continuous recording sheet 17. The heat energy from the heating elements 27 is set lower according to a decrease in the speed of the continuous recording sheet 17. If the feeding speed of the continuous recording sheet 17 is very small and near to zero (0), the heat energy is set as zero to prevent unnecessary heating of the continuous recording sheet 17. It is to be noted that the motor 19 being used can be a stepping motor so the pulse generator 51 may not be used. Drive pulses for the stepping motor 19 can be counted to determine the timing described above.

The sheet reservoir 12 is constituted by the feeder roller set 21, a movable guide plate 55 and a feeder roller set 56. The feeder roller set 21 is an element in the image forming component 11, while the feeder roller set 56 is an element of the cutter 13. A driving roller 56*a* in the feeder roller set 56 is rotated at a higher peripheral speed than a driving roller 21*a* in the feeder roller set 21, to reserve one portion of the continuous recording sheet 17 by suspending the portion between the feeder roller set 21 and the feeder roller set 56. Note that the peripheral speed of the feeder roller set 56 can be equal to or higher than zero.

The movable guide plate 55 is movable pivotally about an axis about which the driving roller 21*a* rotates. The movable guide plate 55 guides a front edge of the continuous recording sheet 17 toward the cutter 13. An end of the movable guide plate 55, when the front edge of the continuous recording sheet 17 passes, is in a first position located close to an entrance of the feeder roller set 56 for guiding as indicated by the phantom line, and after the front edge of the continuous recording sheet 17 passes, is in a second position for reserving the continuous recording sheet 17 in a looped manner as indicated by the solid lines. As the portion of the continuous recording sheet 17 is suspended in the space defined by retracting of the movable guide plate 55 in the second position, the continuous recording sheet 17 is reserved.

The cutter 13 is constituted by the feeder roller set 56, feeder roller sets 57 and 58, an indicia sensor 60 and cutter blades 61. A motor 62 causes the feeder roller sets 56–58 to rotate. A motor driver 63 is controlled by the system controller 31, and drives the motor 62. A cutter driver 64 is controlled by the system controller 31, and drives the cutter blades 61 to cut the continuous recording sheet 17 along borderlines between images to remove portions with the cutting and sorting indicia 42 and 43. Thus, prints 70 with the images are produced.

The indicia sensor 60 consists of a line sensor having an array of a great number of photo receptor elements. If a detection signal changes over upon a reach of the indicia sensor 60 to the position of the indicia and if the color is black, then the system controller 31 detects existence of the cutting indicia 42 or the sorting indicia 43. Then the size L1 or L2 of the black zone in the sub scan direction is evaluated, to determine one of the cutting and sorting indicia 42 and 43.

In response to signals of detecting the cutting and sorting indicia 42 and 43, the system controller 31 controls rotation of the motor 62 and positions borderlines of the continuous recording sheet 17 at the cutter blades 61. In FIG. 4, cutting lines 80 and 81 are used for cutting of the continuous recording sheet 17 by the cutter blades 61 in operation at two times. Thus, the cutting and sorting indicia 42 and 43 are cut away from the continuous recording sheet 17, to obtain the prints 70 having respectively the images 41. After the cutting, each tray 75 collectively receives the prints 70 in a stacked manner. In response to the detection signal of the sorting indicia 43, the system controller 31 controls the sorter 14 and sets a new one of the trays 75 in a print dropping position. The prints 70 are inserted in the trays 75 per group according to each request for printing. Series of the prints 70 are grouped.

A conveyor belt 76 is included in the sorter 14, and provided with the numerous trays 75 arranged in a predetermined pitch. According to a detection signal of the sorting indicia 43, the conveyor belt 76 is driven and turned by an amount of the pitch of the trays 75, a succeeding one of which is set in the position for receiving drop of prints.

The operation of the present embodiment is described now. At first, a printing starting key is depressed to start printing an image. The thermal head 22, prior to printing, applies preheating heat energy to unit printing regions according to ejected amounts at which ink will be provided. Then the printing head 23 ejects ink to the continuous recording sheet 17, to print a full-color image. The ink can be dried efficiently, because the continuous recording sheet 17 has been preheated.

In FIG. 4, the cutting indicia 42 is printed at a borderline of the images 41 in the size L1. Also, the sorting indicia 43 is printed in the size L2 at a beginning or end of a series of images for one printing request. The cutting and sorting indicia 42 and 43 are printed by ejecting of ink through nozzles at a higher flow rate than that for image printing. Thus, the nozzles are cleaned. Even if choking occurs in the nozzles, those are cleaned automatically, because the cutting and sorting indicia 42 and 43 are printed so as to eliminate choking.

A portion including the cutting indicia 42 or the sorting indicia 43 is cut away from the continuous recording sheet 17 by cutting along the cutting lines 80 and 81 in response to a detection signal of detecting the cutting indicia 42 or the sorting indicia 43.

At the start of printing, the cutting indicia 42 has been printed in a portion along a front edge of the images 41. Now, the front portion along the borderline of the images 41 is cut away. If the sorting indicia 43 is detected, the image is cut away in the position of the sorting indicia 43 similarly to the cutting indicia 42. In addition, a sorting signal is generated and output to inform an end of a series of the images related to a printing request. If there remains no image to be printed, then the final image frame is cut away.

The front edge of the continuous recording sheet 17 is returned to the feeder roller set 21 in the image forming component 11, and becomes ready for printing.

Figure 5:
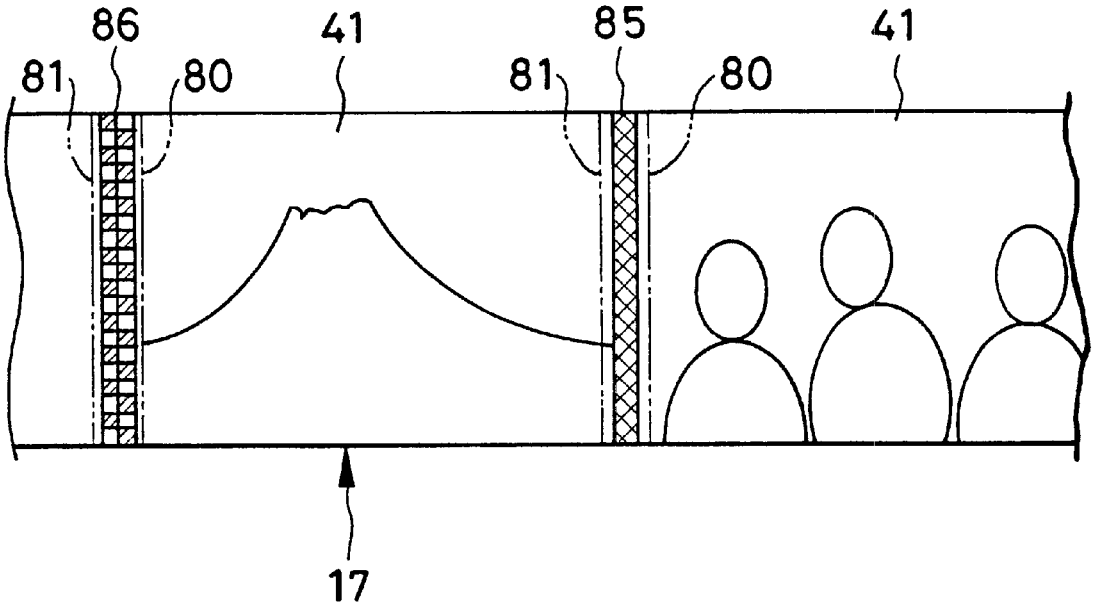
FIG. 5 is a plan illustrating the same as FIG. 4 but having a patterned sorting indicia.

In the present embodiment illustrated in FIG. 4, the sorting indicia 43 is discerned from the cutting indicia 42 by the difference between their sizes L1 and L2 in the sub scan direction S. Alternatively, a pattern of printing may be predetermined differently between cutting and sorting indicia. An example is depicted in FIG. 5, where a cutting indicia 85 is a black colored zone. A sorting indicia 86 is a patterned indicia of a checkered manner in which black portions are arranged alternately with colorless or blank portions.

Figure 6:
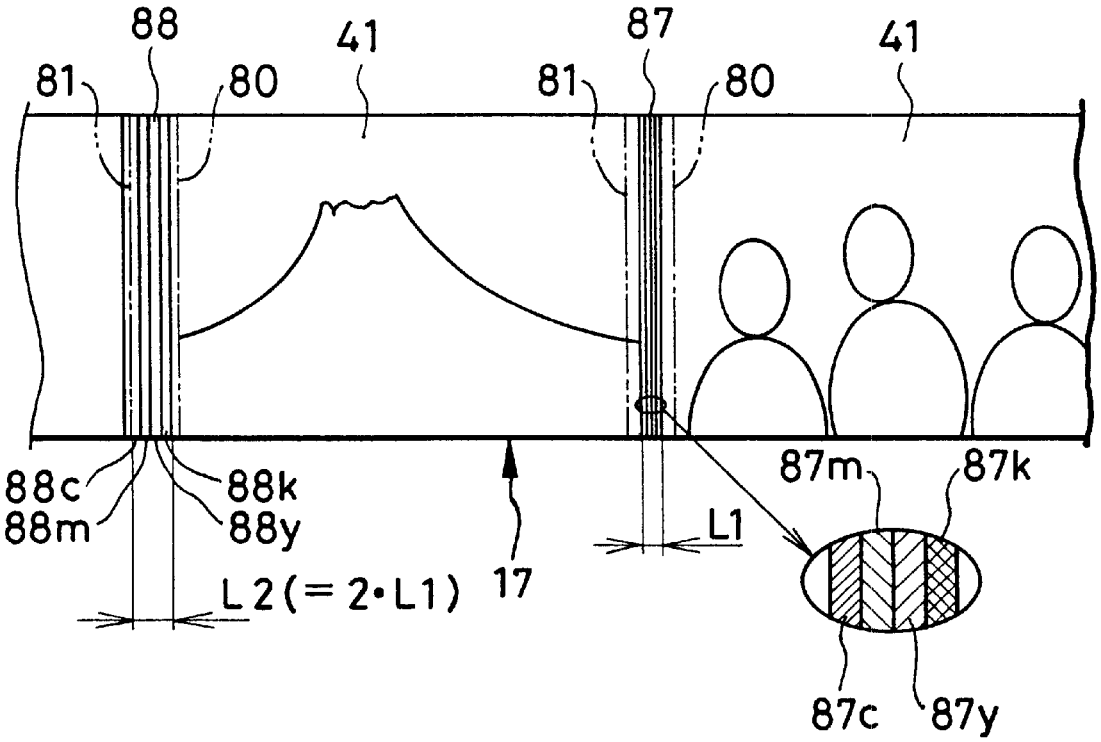
FIG. 6 is a plan illustrating another preferred embodiment provided with stripe-patterned cutting and sorting indicia.
Figure 7:
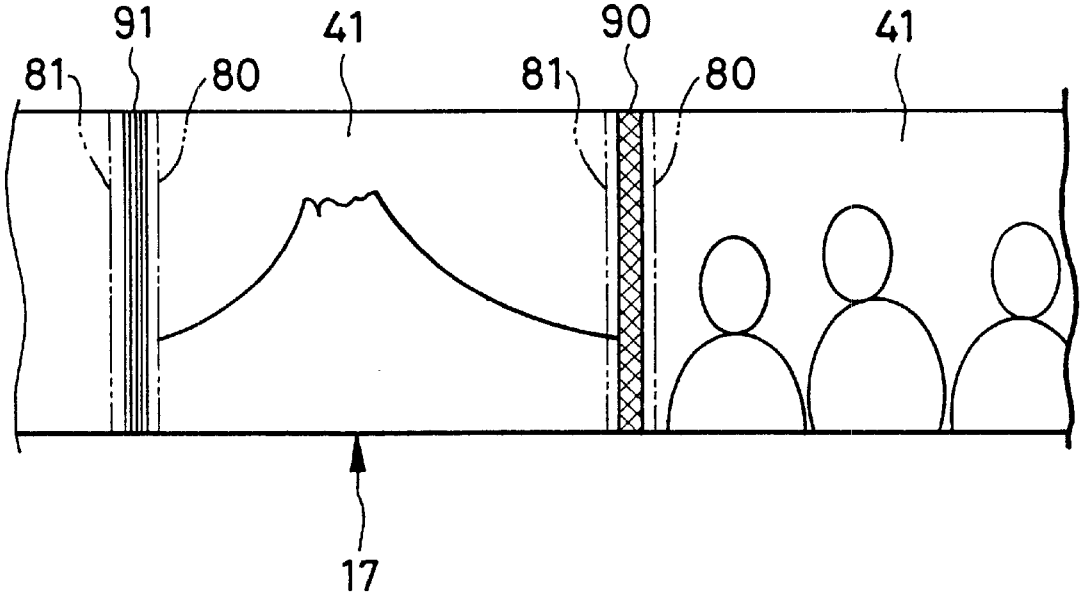
FIG. 7 is a plan illustrating the same as FIG. 6 but having a cutting indicia with a single colored zone.

In the above embodiments, the cutting indicia 42 and 85 and the sorting indicia 43 and 86 are black by coloring of ink of the black, yellow, magenta and cyan colors. Another preferred embodiment is illustrated in FIG. 6. A cutting indicia 87 is constituted by colored stripes 87*k*, 87*y*, 87*m* and 87*c* of the black, yellow, magenta and cyan colors. A sorting indicia 88 is constituted by colored stripes 88*k*, 88*y*, 88*m* and 88*c*. The sizes L1 and L2 are differently determined in the cutting indicia 87 and the sorting indicia 88, to distinguish the cutting indicia 87 and the sorting indicia 88 from each other. Also, FIG. 7 illustrates one preferred embodiment, in which a cutting indicia 90 is a black colored zone. A sorting indicia 91 is constituted of stripes. Furthermore, cutting and sorting indicia (not shown) may be determined differently by printing the stripes in different sequences of the separate colors.

Figure 8:
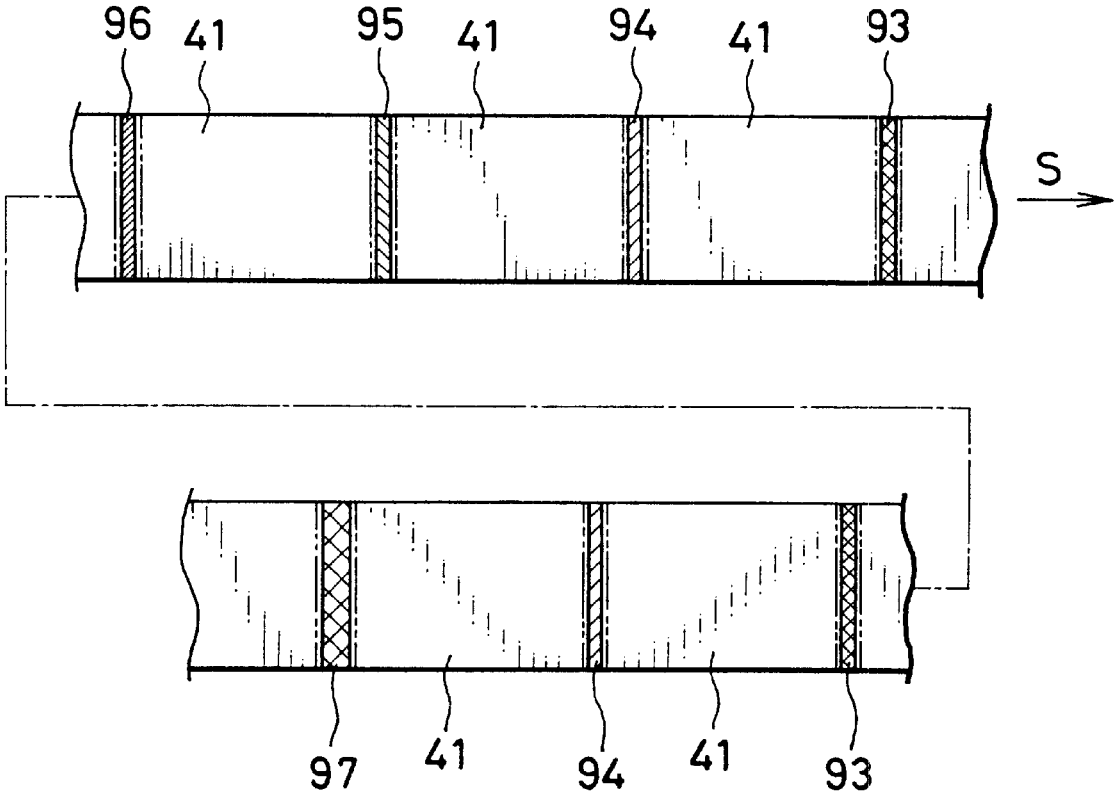
FIG. 8 is a plan illustrating a preferred embodiment in which cutting indicia of four colors are cyclically printed.

Still another preferred embodiment is described now, in which the nozzles are cleaned gradually group after group. In FIG. 8, a first cutting indicia 93 of the black color is printed at a first image. A second cutting indicia 94 of the yellow color is printed at a second image. A third cutting indicia 95 of the magenta color is printed at a third image. A fourth cutting indicia 96 of the cyan color is printed at a fourth image. A sorting indicia 97 is a black colored zone having a greater size in the sub scan direction S than the cutting indicia 93–96, and thus is distinct from the cutting indicia 93–96. Furthermore, a sorting indicia may be constituted by one stripe of a predetermined color formed by superimposing the plural colors, and may be distinct from any of the black, yellow, magenta and cyan colors of the cutting indicia. Also, a sorting indicia may be constituted by one stripe including a set of plural colored zones in a manner distinct from the cutting indicia.

In the above embodiments, the cutting and sorting indicia are depicted in exaggeration, and are actually smaller than their depicted size. A region of the cutting and sorting indicia is as large as 0.1–2 mm in the sub scan direction S.

Note that heat energy of preheating with the thermal head 22 may be determined with differences between pixels, but also may be determined equally in a simple manner between pixels. Also, a heater may be incorporated in the platen roller instead of using the thermal head, to heat the continuous recording sheet 17 to dry the ink.

Furthermore, hot air may be applied to the ink for drying the ink after being ejected instead of preheating. Also, application of hot air may be added to the use of the preheating. For such a case, a hot air blow head may be used as a drier device to blow the recording sheet with hot air. Also, ink can be dried naturally with time without using preheating device or the drier.

Figure 9:
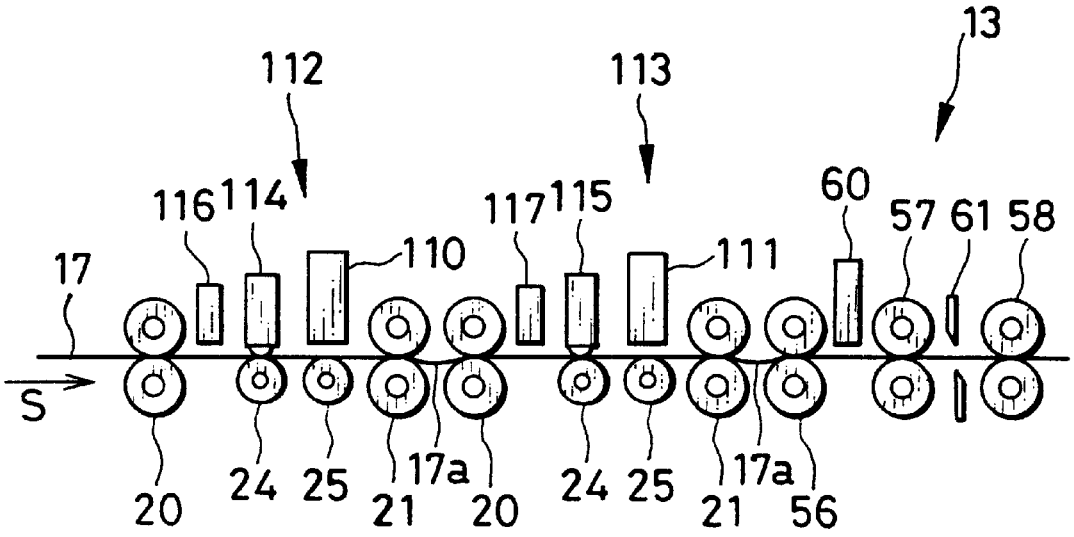
FIG. 9 is an explanatory view in elevation, illustrating another preferred ink jet printer having two printing heads.

In the above embodiments, the printing head 23 includes the arrays of the nozzles 35–38 as illustrated in FIG. 2. However, plural printing heads may be used in an ink jet printer. In FIG. 9, two image forming components 112 and 113 are provided in the ink jet printer. The image forming component 112 includes an ink jet printing head 110 having an array of nozzles for black ink. The image forming component 113 includes an ink jet printing head 111 having arrays of nozzles for yellow, magenta and cyan ink. Preheating thermal heads 114 and 115 are positioned upstream from respectively the printing heads 110 and 111 in the image forming components 112 and 113. Note that a front edge sensor 116 detects a front edge of the continuous recording sheet 17. An indicia sensor 117 detects the cutting indicia. The printing starting position is determined according to detection signals output by the front edge sensor 116 and the indicia sensor 117.

Looped portions 17*a* of the continuous recording sheet 17 are formed between the image forming components 112 and 113 and between the image forming component 113 and the cutter 13, and are adapted to avoiding transmission of minute movement of the continuous recording sheet 17 from one of the image forming components 112 and 113 to the remainder. The ejected amount of ink for a unit heating region of one heating elements to the continuous recording sheet 17 is obtained according to the image data. Heat energy of the heating elements is controlled according to the ejected amount of the ink. If the ejected amount is high, the heat energy is determined high, to dry the ink in considerably short time.

Figure 10:
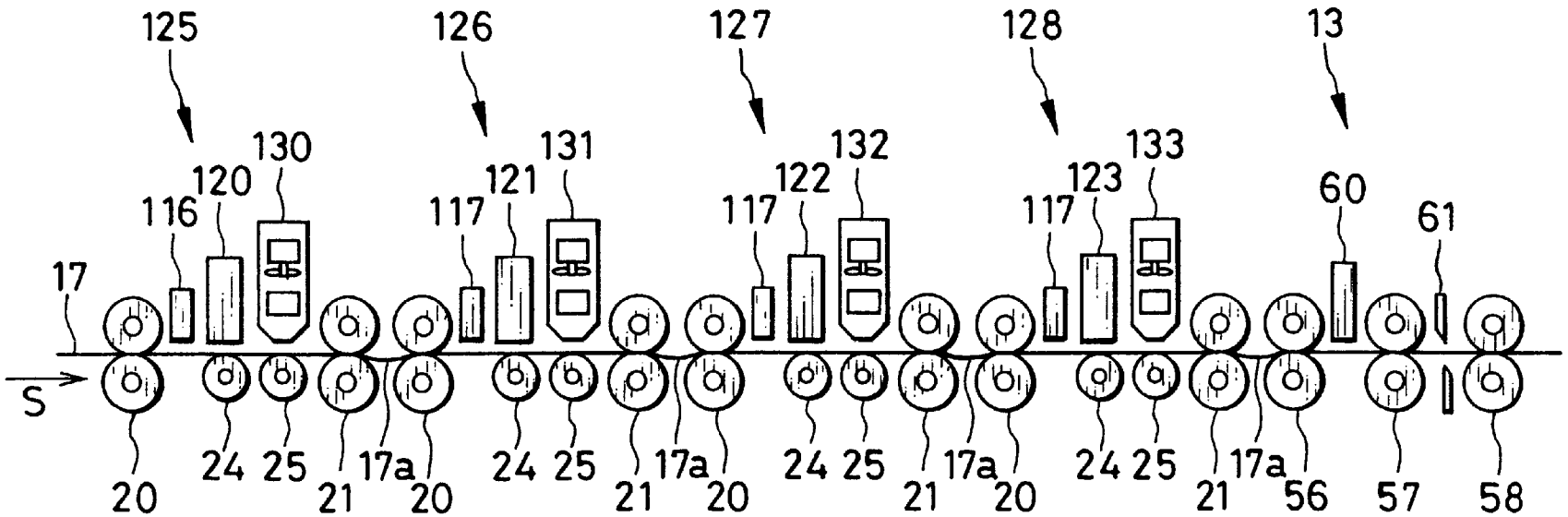
FIG. 10 is an explanatory view in elevation, illustrating a preferred ink jet printer having four printing heads.

In the present embodiment, cutting and sorting indicia are printed by cleaning of the printing heads 110 and 111. Elements similar to those depicted in FIGS. 9 and 10 are designated with identical reference numerals in FIG. 1. Furthermore, a hot air blow head 130 illustrated in FIG. 10 may be used instead of the thermal heads 114 and 115. The hot air blow head 130 is positioned downstream from the printing heads 110 and 111 according to feeding of the continuous recording sheet 17.

In FIG. 10, another preferred ink jet printer is depicted, including four image forming components 125, 126, 127 and 128. Ink jet printing heads 120, 121, 122 and 123 are disposed in respectively the image forming components 125, 126, 127 and 128, and eject respectively black, yellow, magenta and cyan ink. Hot air blow heads 130, 131, 132 and 133 are positioned downstream from respectively the printing heads 120–123, and apply hot air to the continuous recording sheet 17 for drying according to ejected amounts of ink to the unit drying regions HA. The printing heads 120–123 are driven to print a trial printed pattern at a front or rear edge of each image. The trial printed pattern constitutes each one of cutting and sorting indicia. Note that, in the present embodiment, the thermal head can be positioned as depicted in FIG. 9 to preheat the continuous recording sheet 17 instead of the hot air blow heads 130–133. Ejected ink can be dried.

Furthermore, an ink jet printing head may have plural arrays of the nozzles 35 for black ink. Also, ink jet printing heads may have plural arrays of the nozzles 36–38 for yellow, magenta and cyan ink. This being so, the number of linearly arranged nozzles with reference to the main scan direction becomes smaller. Thus, manufacture of the nozzles 35–38 can be still easier. It is also to be noted that plural ink jet printing heads may be combined, may have respectively a smaller size in the main scan direction, to constitute a single head group extending in the main scan direction crosswise to the feeding of the continuous recording sheet 17. It is possible in the plural printing heads to eliminate choking of ink by printing a trial printed pattern for cleaning.

It is to be noted that a preferable size of each of photo receptor elements in the indicia sensor 60, 117 is at least two times as great as a smallest size of a pixel to be printed in the continuous recording sheet 17 as viewed in the main scan direction M. If failure in ejecting ink occurs to cause abnormality in printing of some of the pixels, it is possible to detect the cutting or sorting indicia reliably.

Furthermore, it is possible to check normality in operation of the nozzles in the printing head by detecting the density of coloring pixels by use of a cutting indicia or sorting indicia. If the indicia sensor 60, 117 for detecting the cutting indicia and sorting indicia is used to detect the density of each pixel, there is no need of providing an additional sensor. In view of measuring the density of each pixel, it is preferable that a size of photo receptor elements in the main scan direction should be at most a half of the minimum pixel size. For the indicia sensor 60, 117 to detect each of the pixels with certainty, it is preferable that a size of the photo receptor elements in the main scan direction should be at least a half of the minimum pixel size. If the indicia sensor 60, 117 is desired to be used also as failing nozzle detector, the photo receptor elements are constructed to have a size at most ½ as great in the main scan direction M as the minimum pixel size so as to detect failing nozzles having abnormality in operation. To detect the cutting indicia, an average of outputs of plural adjacent ones of the photo receptor elements is obtained. For example, an average of outputs of adjacent four of the photo receptor elements is obtained. According to the average output, the cutting indicia can be recognized in a reliable manner.

In the above embodiments, the cutting and sorting indicia are extended in the whole width of the continuous recording sheet 17, so all the nozzles are cleaned at one time. However, nozzles may be grouped in a number of nozzle groups. The nozzle groups may be driven for the purpose of cleaning one group after another so as to clean the nozzles gradually.

Figure 11:
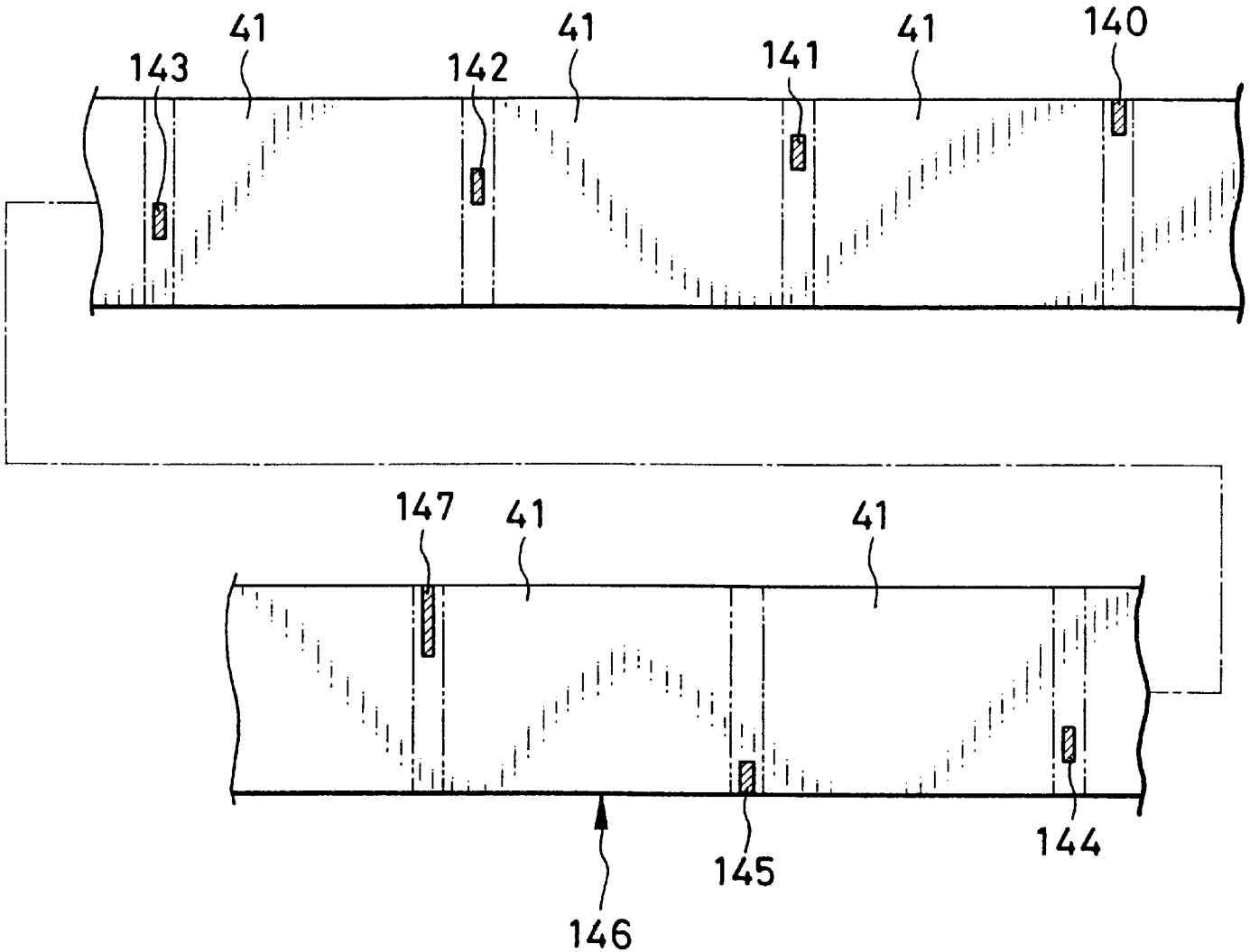
FIG. 11 is a plan illustrating still another preferred embodiment in which cutting indicia of six positions are cyclically printed.

FIG. 11 illustrates examples of cutting and sorting indicia printed by nozzle cleaning. All the nozzles are grouped into six groups with reference to the main scan direction M, and print six cutting indicia 140, 141, 142, 143, 144 and 145. A sequence of printing those results in cleaning of all the nozzles. Also, continuous recording sheet 146 as recording material is cut at the cutting indicia 140–145. A sorting indicia 147 is determined to have a greater size than the cutting indicia 140–145, and extends in some of positions where the cutting indicia 140–145 are printed. For example, the sorting indicia 147 is twice as long as each one of the cutting indicia 140–145 in the main scan direction.

Furthermore, the sorting indicia 147 may have a shape other than the above so as to discern the sorting indicia 147 from the cutting indicia in a pattern recognizing manner. For example, a size, color, shape or other structure of the sorting indicia may be determined in a manner distinct from the cutting indicia. The patterned sequence of printing a series of the cutting indicia or the sorting indicia may be suitably changed. Furthermore, one of a plurality of the cutting indicia may be used as the sorting indicia. The sorting indicia can be associated with a particularly predetermined position of printing, which can be discerned from the cutting indicia printed in different positions from the sorting indicia. Alternatively, a second indicia may be printed in a position the same as a first indicia as cutting indicia precedent to the second indicia, and the second indicia may be predetermined as the sorting indicia distinct from the cutting indicia according to the same position of the second indicia as the first indicia.

Figure 12:
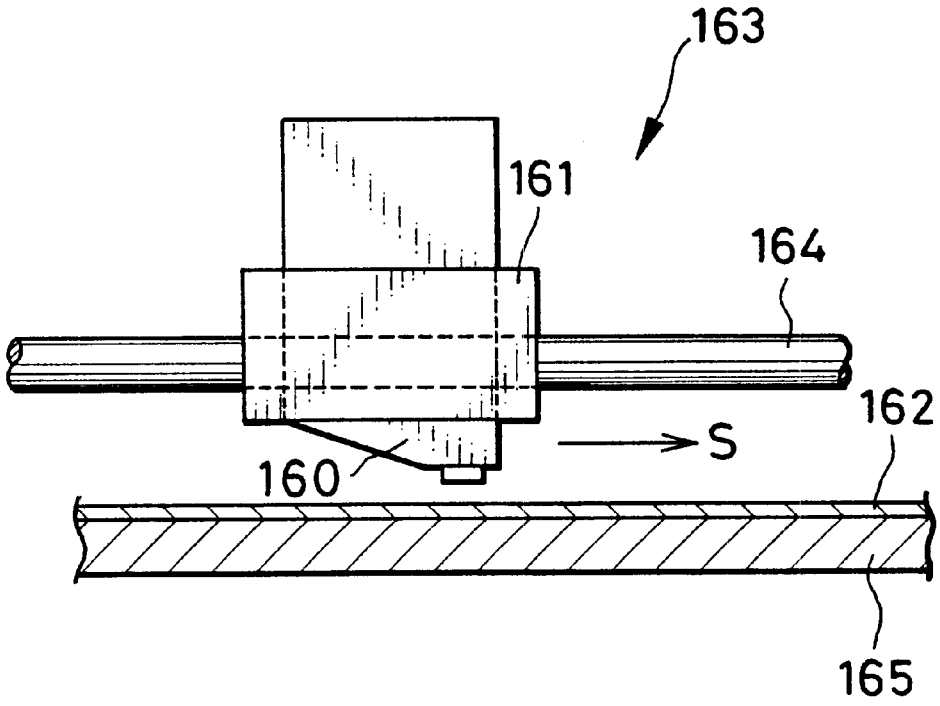
FIG. 12 is a front elevation illustrating an ink jet printer of a serial printing type.

In the above embodiments, the ink jet printers are a line printing type in which an image is printed one line after another in the direction crosswise to the feeding of the continuous recording sheet 17. Also, FIG. 12 illustrates an embodiment of ink jet printer 163 of a serial printing type. An ink jet printing head 160 is disposed in a head carriage 161 as moving mechanism, which moves the printing head 160 in the sub scan direction S crosswise to the long shape of continuous recording sheet 162 as recording material. Note that there is a guide rod 164 for guiding the head carriage 161 in the sub scan direction S of the continuous recording sheet 162. A platen 165 as second moving mechanism supports the continuous recording sheet 162, and moves the continuous recording sheet 162 in the main scan direction M.

Figure 13:
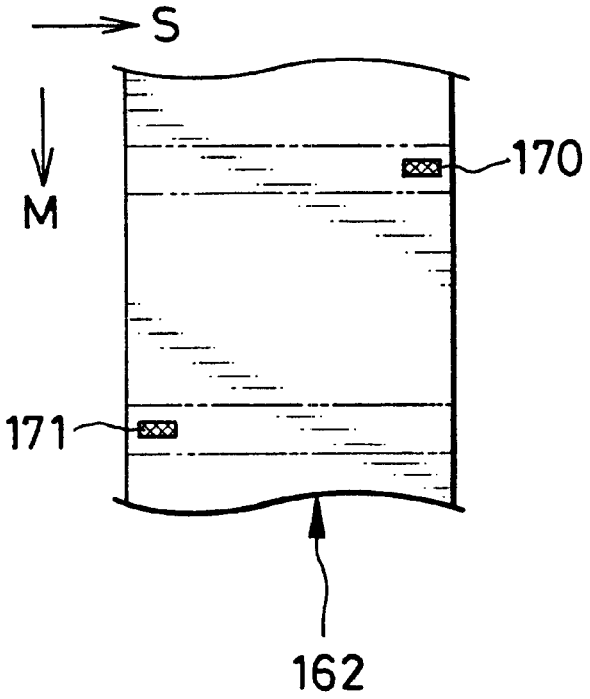
FIG. 13 is a plan illustrating continuous recording sheet provided with cutting and sorting indicia by the printer of FIG. 12.

To print a cutting indicia 170 and a sorting indicia 171 in the ink jet printer 163, the head carriage 161 is moved in the sub scan direction S to drive the nozzles for a predetermined time. In FIG. 13, the cutting indicia 170 is printed close to a first lateral edge of the continuous recording sheet 162. The sorting indicia 171 is printed close to a second lateral edge of the continuous recording sheet 162, and discernible from the cutting indicia 170. It is to be noted that a sorting indicia may be distinct from a cutting indicia in any of a width, length, color, shape, position or the like.

Furthermore, it is possible in the ink jet printer 163 to group the nozzles in the ink jet printing head 160 into plural nozzle groups. The nozzle groups may be driven for the purpose of cleaning one group after another so as to clean the nozzles gradually. Grouping the nozzles may be such that one nozzle group is adjacent to another nozzle group. Alternatively, a first nozzle group may be constituted by nozzles Nos. 1, N+1, 2N+1, . . . , pN+1, a second nozzle group may be constituted by nozzles Nos. 2, N+2, 2N+2, . . . , pN+2, and so on. Each of cutting indicia can be constituted by a train of plural dots.

In the above embodiments, piezoelectric elements are used in the ink jet printing heads 23, 110, 111 and 120–123. However, other types of structures for ejecting ink may be used in ink jet printing. For example, a flow rate control diaphragm type may be used, in which piezoelectric elements are combined with diaphragms. A thermal ink jet printing may be used, in which heating elements heat liquid ink, generate bubbles and eject the ink. A continuous ink jet printing may be used, in which ink droplets are charged by means of electrodes, and deflection electrodes and separator plates are combined to eliminate and withdraw unnecessary ink droplets, and remaining ink droplets are ejected to the recording material. An electrostatic attraction ink jet printing may be used, in which high voltage is applied according to an image signal, and causes attraction of ink droplets to recording material. An ultrasonic ink jet printing may be used, in which ultrasonic waves are applied to vibrate liquid ink, and generate ink droplets. Furthermore, the colors of ink may be light magenta, light cyan and the like instead of the yellow, magenta, cyan and black colors.

In the above embodiments, a roll type of the continuous recording sheet is used. Also, a recording sheet of a limited size in a quadrilateral shape may be used. In each of the recording sheet, two or more images may be printed in series. The cutting indicia 42 as trial printed pattern is printed in a portion outside an effective image printing region in the recording sheet. The outside portion having the trial printed pattern is cut away by a cutter if required. Furthermore, a sorting indicia may be printed in the recording sheet as a trial printed pattern.

In the above embodiments, the continuous recording sheet is used to print an image. Also, a recording sheet strip in a long shape but with a smaller length than the continuous recording sheet may be used.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet printing method in which a printing head is used, and has plural nozzles for ejecting ink, said ink jet printing method comprising steps of:

printing at least one image to recording material with said printing head; and before or after printing said image, cleaning said printing head by driving at least part of said plural nozzles, wherein said at least one image is plural images and said printing head is cleaned in a beginning or ending position of respectively said plural images, said printing head prints a cutting indicia to said recording material upon being cleaned, and said cutting indicia is adapted to separating said images.

2. An ink jet printing method as defined in claim 1, wherein said recording material is continuous recording sheet or a recording sheet strip.

3. An ink jet printer as defined in claim 1, wherein the cleaning step further comprises ejecting ink through said plural nozzles at a higher flow rate than that for printing said at least one image.

4. An ink jet printing method in which a printing head is used, and has plural nozzles for ejecting ink, said ink jet printing method comprising steps of:

printing plural images to recording material with said printing head; and before or after one of said plural images, cleaning said printing head by driving at least part of said plural nozzles in a beginning or ending position of one series of said plural images, to print a sorting indicia to said recording material, said sorting indicia being different from a cutting indicia in at least one of a width, length, position, color and shape.

5. An ink jet printing method as defined in claim 4, wherein said sorting indicia is different from said cutting indicia in a size with reference to a direction in which said plural images are arranged.

6. An ink jet printing method as defined in claim 4, wherein at least one of said cutting indicia and said sorting indicia includes plural colored portions arranged in a patterned manner.

7. An ink jet printing method as defined in claim 6, wherein said cutting indicia includes said plural colored portions arranged at a first pitch, said sorting indicia includes said plural colored portions arranged at a second pitch different from said first pitch.

8. An ink jet printing method as defined in claim 6, wherein a remaining one of said cutting indicia and said sorting indicia includes a single colored portion.

9. An ink jet printing method as defined in claim 8, wherein said plural colored portions are dots.

10. An ink jet printing method as defined in claim 8, wherein said plural colored portions are stripes.

11. An ink jet printing method as defined in claim 4, wherein said ink is ink of first to Nth colors, said images are full-color images;

said plural nozzles are arranged in first to Nth groups for ejecting said ink of respectively said first to Nth colors;

said cleaning step drives one of said first to Nth groups at each time of printing one of said plural images, to print first to Nth cutting indicia cyclically in respectively said first to Nth colors.

12. An ink jet printing method as defined in claim 4, wherein said sorting indicia is different in a position from said cutting indicia.

13. An ink jet printing method as defined in claim 12, wherein said plural nozzles are arranged in a main scan direction and grouped in first to Pth groups with reference to said main scan direction;

said cleaning step drives one of said first to Pth groups at each time of printing one of said plural images, to print first to Pth cutting indicia cyclically, said first to Pth cutting indicia being offset from one another with reference to said main scan direction.

14. An ink jet printing method as defined in claim 12, wherein said sorting indicia is different in a position from said cutting indicia with reference to a direction crosswise to arrangement of said plural images.

15. An ink jet printer as defined in claim 4, wherein the cleaning step further comprises ejecting ink through said plural nozzles at a higher flow rate than that for printing said at least one image.

16. An ink jet printer as defined in claim 4, wherein said sorting indicia is printed at an end or a beginning of said plural images for one printing request.

17. An ink jet printer comprising:

a printing head including plural nozzles arranged in a main scan direction, for ejecting ink;

a moving mechanism for moving one of said printing head and recording material relative to a remainder thereof in a sub scan direction, to print at least one image to said recording material; and a controller for operating before or after printing said image, to clean said printing head by driving at least part of said plural nozzles, wherein said at least one image is plural images, and said controller cleans said printing head in a beginning or ending position of respectively said plural images, said printing head prints a cutting indicia to said recording material upon being cleaned, and said cutting indicia is adapted to separating said images.

18. An ink jet printer as defined in claim 17, wherein said recording material is continuous recording sheet or a recording sheet strip.

19. An ink jet printer as defined in claim 17, further comprising:

an indicia sensor for detecting said cutting indicia; and a cutter for cutting said recording material at said cutting indicia in response to detection of said cutting indicia, to obtain prints having respectively said images.

20. An ink jet printer as defined in claim 19, wherein said printing head prints a sorting indicia to said recording material upon being cleaned in a beginning or ending position of one series of said plural images, said sorting indicia being different from said cutting indicia in at least one of a width, length, position, color and shape;

said indicia sensor further detects said sorting indicia;

further comprising a sorter, actuated in response to detection of said sorting indicia, for grouping said prints by said series of said images.

21. An ink jet printer as defined in claim 20, wherein said sorting indicia is different in a position from said cutting indicia with reference to a direction crosswise to arrangement of said plural images.

22. An ink jet printer as defined in claim 20, wherein said sorting indicia is different from said cutting indicia in a size with reference to said sub scan direction.

23. An ink jet printer as defined in claim 20, wherein at least one of said cutting indicia and said sorting indicia includes plural colored portions arranged in a patterned manner.

24. An ink jet printer as defined in claim 23, wherein said cutting indicia includes said plural colored portions arranged at a first pitch, said sorting indicia includes said plural colored portions arranged at a second pitch different from said first pitch.

25. An ink jet printer as defined in claim 23, wherein a remaining one of said cutting indicia and said sorting indicia includes a single colored portion.

26. An ink jet printer as defined in claim 25, wherein said plural colored portions are dots.

27. An ink jet printer as defined in claim 25, wherein said plural colored portions are stripes.

28. An ink jet printer as defined in claim 20, wherein said ink is ink of first to Nth colors, said images are full-color images;

said plural nozzles are arranged in first to Nth groups for ejecting said ink of respectively said first to Nth colors;

said controller drives one of said first to Nth groups at each time of printing one of said plural images, to print first to Nth cutting indicia cyclically in respectively said first to Nth colors.

29. An ink jet printer as defined in claim 20, wherein said sorting indicia is different in a position from said cutting indicia.

30. An ink jet printer as defined in claim 29, wherein said plural nozzles are grouped in first to Pth groups with reference to said main scan direction;

said controller drives one of said first to Pth groups at each time of printing one of said plural images, to print first to Pth cutting indicia cyclically, said first to Pth cutting indicia being offset from one another with reference to said main scan direction.

31. An ink jet printer comprising:

a printing head including plural nozzles arranged in a main scan direction, for ejecting ink;

a head carriage for moving said printing head in a sub scan direction;

a moving mechanism for moving one of said head carriage and recording material relative to a remainder thereof in said main scan direction, to print at least one image to said recording material; and a controller for operating before or after printing said image, to clean said printing head by driving at least part of said plural nozzles, wherein said at least one image is plural images, and said controller cleans said printing head in a beginning or ending position of respectively said plural images, said printing head prints a cutting indicia to said recording material upon being cleaned, and said cutting indicia is adapted to separating said images.

32. An ink jet printer comprising:

a printing head including plural nozzles arranged in a main scan direction, for ejecting ink;

a moving mechanism for moving one of said printing head and recording material relative to a remainder thereof in a sub scan direction, to print at least one image to said recording material; and a controller for operating before or after printing said image, to clean said printing head by driving at least part of said plural nozzles, wherein said at least one image is plural images, and said controller cleans said printing head in a beginning or ending position of respectively said plural images, said printing head prints a sorting indicia to said recording material upon being cleaned in a beginning or ending position of one series of said plural images, said sorting indicia being different from a cutting indicia in at least one of a width, length, position, color and shape;

further comprising a sorter, actuated in response to detection of said sorting indicia, for grouping said prints by said series of said images.

33. An ink jet printing method in which a printing head is used, and has plural nozzles for ejecting ink, said ink jet printing method comprising steps of:

printing at least one image to recording material with said printing head; and before or after printing said image, cleaning said printing head by driving at least part of said plural nozzles, wherein said at least one image is plural images and said printing head is cleaned in between adjoining said plural images, said printing head prints a cutting indicia to said recording material upon being cleaned, and said cutting indicia is adapted to separating said images.

* * * * *